United States Patent [19]

Ringgenberg et al.

[11] Patent Number: 4,753,292

[45] **Date of Patent: * Jun. 28, 1988**

[54] METHOD OF WELL TESTING

[75] Inventors: Paul D. Ringgenberg; Wesley J. Burris, II, both of Duncan, Okla.

[73] Assignee: Halliburton Company, Duncan, Okla.

[ * ] Notice: The portion of the term of this patent subsequent to Jan. 6, 2004 has been disclaimed.

[21] Appl. No.: 751,758

[22] Filed: Jul. 3, 1985

[51] Int. Cl.[4] ..... E21B 49/08; E21B 34/10

[52] U.S. Cl. ..... 166/250; 166/264; 166/321; 166/324

[58] Field of Search ..... 166/250, 264, 316, 321, 166/332, 324

[56] References Cited

U.S. PATENT DOCUMENTS

| | | | |
|---|---|---|---|
| Re. 29,562 | 3/1978 | Wray et al. . | |
| 3,856,085 | 12/1974 | Holden et al. . | |
| 3,976,136 | 8/1976 | Farley et al. . | |
| 4,063,593 | 12/1977 | Jessup . | |
| 4,064,937 | 12/1977 | Barrington . | |
| 4,311,197 | 1/1982 | Hushbeck . | |
| 4,319,633 | 3/1982 | McMahan et al. . | |
| 4,319,634 | 3/1982 | McMahan et al. . | |
| 4,421,172 | 12/1983 | McMahan . | |
| 4,452,313 | 6/1984 | McMahan . | |
| 4,467,867 | 8/1984 | Baker | 166/332 X |
| 4,502,537 | 3/1985 | Carter, Jr. . | |
| 4,633,952 | 1/1987 | Ringgenberg | 166/336 |

OTHER PUBLICATIONS

Application Ser. No. 596,321 filed Apr. 3, 1984, entitled Multi-Mode Testing Tool, by Paul David Ringgenberg.

*Primary Examiner*—George A. Suchfield
*Attorney, Agent, or Firm*—James R. Duzan; J. A. Walkowski

[57] ABSTRACT

A method of well testing, including treating, whereby a testing string including a tool bore closure valve is run into the well bore with the valve in an open mode, the string may be automatically filled, a packer may be pressure tested without cycling the tool bore closure valve, and fluids may be spotted into the testing string, displacing wellbore fluids from the bottom of the testing string, prior to running the test.

14 Claims, 4 Drawing Sheets

METHOD OF WELL TESTING

BACKGROUND OF THE INVENTION

This invention relates to an improved method of formation flow testing for oil and gas wells. This invention is particularly useful in the testing of offshore wells where it is desirable to conduct testing operations and well stimulation operations utilizing the testing string tools with a minimum of testing string manipulation, and preferably with the blowout preventers closed during most operations.

It is known in the art that tester valves and sampler valves for use in oil and gas wells may be operated by applying pressure increases to the fluid in the annulus between the wellbore and testing string therein of a well. For instance U.S. Pat. No. 3,664,415 to Wray et al discloses a sampler valve which is operated by applying annulus pressure increases against a piston in opposition to a predetermined charge of inert gas. When the annulus pressure overcomes the gas pressure, the piston moves to open a sampler valve thereby allowing formation fluid to flow into a sample chamber contained within the tool, and into the testing string facilitating production measurements and testing.

In U.S. Pat. No. 3,858,649 to Holden et al a tester valve is described which is opened and closed by applying pressure changes to the fluid in the annulus contained between the wellbore and testing string therein of a well. The tester valve contains a supplementing means wherein the inert gas pressure is supplemented by the hydrostatic pressure of the fluid in the annulus contained between the wellbore and testing string therein as the testing string is lowered into the well. This feature allows the use of lower inert gas pressure at the surface and provides that the gas pressure will automatically be adjusted in accordance with the hydrostatic pressure and environment at the testing depth, thereby avoiding complicated gas pressure calculations required by earlier devices for proper operation. The tester valve described in U.S. Pat. No. 3,856,085 to Holden et al likewise provides a supplementing means for the inert gas pressure in a full opening testing apparatus.

This supplementing means includes a floating piston exposed on one side to the inert gas pressure and on the other side to the annulus fluid pressure in order that the annulus fluid pressure can act on the inert gas pressure. The system is balanced to hold the valve in its normal position until the testing depth is reached. Upon reaching the testing depth, the floating piston is isolated from the annulus fluid pressure so that subsequent changes in the annulus pressure will operate the particular valve concerned.

This method of isolating the floating piston has been to close the flow channel from the annulus contained between the wellbore and testing string in a well to the floating piston with a valve which closes upon the addition of weight to the testing string. This is done by setting the testing string down on a packer which supports the testing string and isolates the formation in the well which is to be tested during the test. The apparatus, which is utilized to isolate the floating piston is designed to prevent the isolation valve from closing prematurely due to increasingly higher pressures as the testing string is lowered into the well, contains means to transmit the motion necessary to actuate the packer and is designed to remain open until sufficient weight is set down on the packer to prevent premature isolation of the gas pressure and thus premature operation of the tester valve.

However, since the tester valve described in U.S. Pat. No. 3,856,085 contains a weight operated isolation valve, the tester valve may inadvertently open when being run into the well on a testing string, if a bridge is encountered in the wellbore thereby allowing the weight of the testing string to be supported by the tester valve. Also, in this connection, in highly deviated wellbores it may not be possible to apply sufficient weight to the testing string to actuate the isolation valve portion of the tester valve thereby causing the tester valve to be inoperable. Furthermore, if it is desired to utilize a slip joint in the testing string, unless weight is constantly applied to the slip joint to collapse the same, the isolation valve portion of the tester valve will open thereby causing the tester valve to close.

In U.S. Pat. No. 3,976,136 to Farley et al a tester valve is described which is opened and closed by applying pressure changes to the fluid in the annulus contained between the wellbore and testing string therein of a well and which contains a supplementing means wherein the inert gas pressure is supplemented by the hydrostatic pressure of the fluid in the annulus contained between the wellbore and testing string therein as the testing string is lowered into the well. This tester valve utilizes a method for isolating the gas pressure from the annulus fluid pressure which is responsive to an increase in the annulus fluid pressure above a reference pressure wherein the operating force of the tool is supplied by the pressure of a gas in an inert gas chamber in the tool. The reference pressure used is the pressure which is present in the annulus at the time a wellbore sealing packet is set to isolate one portion of the wellbore from another.

The annulus fluid pressure is allowed to communicate with the interior bore of this tester valve as the testing string is lowered in the wellbore and is trapped as the reference pressure when the packer seals off the wellbore thereby isolating the formation in the well which is to be tested. Subsequent increases in the well annulus pressure above the reference pressure activates a pressure response valve to isolate the inert gas pressure from the well annulus fluid pressure. Additional pressure increases in the well annulus causes the tester valve to operate in the conventional manner.

Once a well has been tested to determine the contents of the various formations therein, it may be necessary to stimulate the various formations to increase their production of formation fluids. Common ways of stimulating formations involve pumping acid into the formations to increase the formation permeability or hydraulic fracturing of the formation to increase the permeability thereof or both.

After the testing of a well, in many instances, it is highly desirable to leave the testing string in place in the well and stimulate the various formations of the well by pumping acids and other fluids into the formations through the testing string to avoid unnecessary delay by pulling the testing string and substituting therefor a tubing string.

During well stimulation operations in locations during extremely cold environmental periods where the tester valves described in U.S. Pat. Nos. 3,856,085 and 3,976,136 are utilized in the testing string if large volumes of cold fluids are pumped through the tester valves, even though the formations surrounding the tester valves may have a temperature of several hundred degrees fahrenheit, the tester valves will be cooled to a temperature substantially lower than the surrounding formations by the cold fluids being pumped therethrough. When these tester valves are cooled by the cold fluids, the inert gas in the valves contracts. Upon the cessation of the pumping of cold fluids through the tester valve, if it is desired to close the tester valve by releasing the fluid pressure in the annulus between the wellbore and testing string, since the inert gas has contracted due to the cooling of the valve, the inert gas in its cooled state may not exert sufficient force to close the tester valve to thereby isolate the formation which has been stimulated from the remainder of the testing string.

The annulus pressure responsive tester valve disclosed in U.S. Pat. No. 4,422,506 includes a pressure assisted isolation valve which includes a pressure differential metering cartridge to control the rate at which the isolation valve returns to the fluid pressure in the annulus between the wellbore and testing string thereby continuously controlling the rate of expansion the inert gas within the gas chamber and the attendant operation of the tester valve regardless of any cooling effect by cold fluids pumped therethrough. The tester valve disclosed therein embodies improvements over the prior art valves described in U.S. Pat. Nos. 3,856,085 and 3,976,136 to eliminate undesirable operating characteristics thereof by including a pressure differential metering cartridge which is similar to that described in U.S. Pat. No. 4,113,012.

All of the above prior art devices, and their methods of use, entail running into the well with the tester and/or sampler valve (generally referred to as a tool bore closure valve) of the testing string in the closed position. This presents a disadvantage in that the testing string cannot automatically fill with well fluids as it is run into the well, which would save the well operator considerable rig time, whether a packer is included in the testing string or the testing string stings into a previously set production packer. In addition, the use of a tool bore closure valve which could be run into the well in an open position, and hence permit filling of the testing string, would prevent a pressure buildup between the tool bore closure valve and the valve in a production packer when the bottom of the testing string "stings" into a production packer set above a producing oil formation prior to opening the packer valve. Furthermore, it would be desirable to be able to pressure test a packer after setting the packer by pressuring up the annulus without cycling the tool bore closure valve, a feature which present tools do not offer. Finally, an initially open tool bore closure valve would permit the spotting of a water cushion or treating fluids into the testing string prior to running the test, by displacing well fluid out the bottom of the testing string, or setting the test string packer, if one is employed therewith.

Attempts have been made to provide an open tool bore closure valve when running into the wellbore, by reversing the normal mounting position of the ball valve used in prior art tester valves so that an increase, instead of a decrease, in annulus pressure closes the ball valve. Needless to say, this arrangement is extremely dangerous as the tool operator must maintain elevated annulus pressure continuously, or the tester valve will open and the upper testing string and surface equipment will be exposed to formation pressure.

SUMMARY OF THE INVENTION

The present invention comprises a method of well testing, including treating, whereby a testing string including a tool bore closure valve is run into the well bore with the valve in an open mode, the string may be automatically filled, a packer may be pressure tested without cycling the tool bore closure valve, and fluids may be spotted into the testing string, displacing wellbore fluids from the bottom of the testing string, prior to running the test.

BRIEF DESCRIPTION OF THE DRAWINGS

The advantages of the present invention will be more fully understood from the following description and drawings wherein.

FIGS. *2a–2e* through illustrate a tool bore closure valve, employed in the method of the present invention, in cross-section.

OVERALL WELL TESTING ENVIRONMENT

Figure 1:
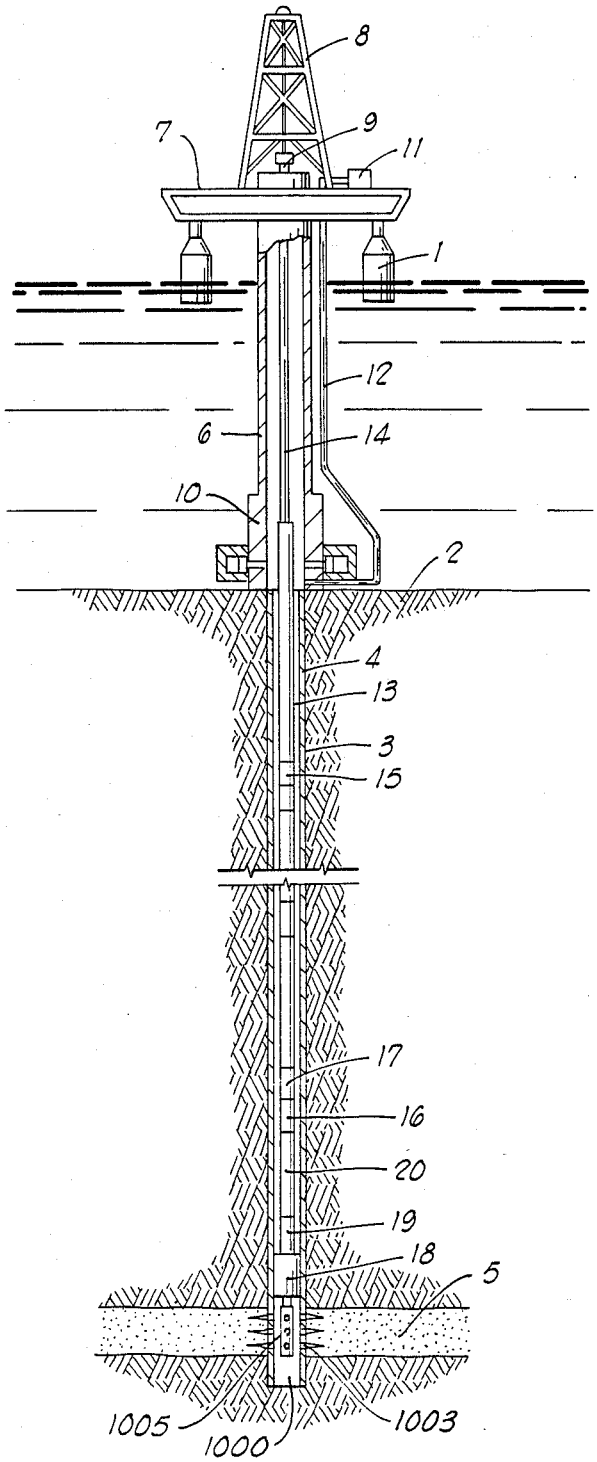
FIG. 1 provides a schematic "vertically sectioned" view of a representative offshore installation which may be employed for testing purposes and illustrates a formation testing "string" or tool assembly in position in a submerged wellbore and extending upwardly to a floating operating and testing station.
Figure 2A:
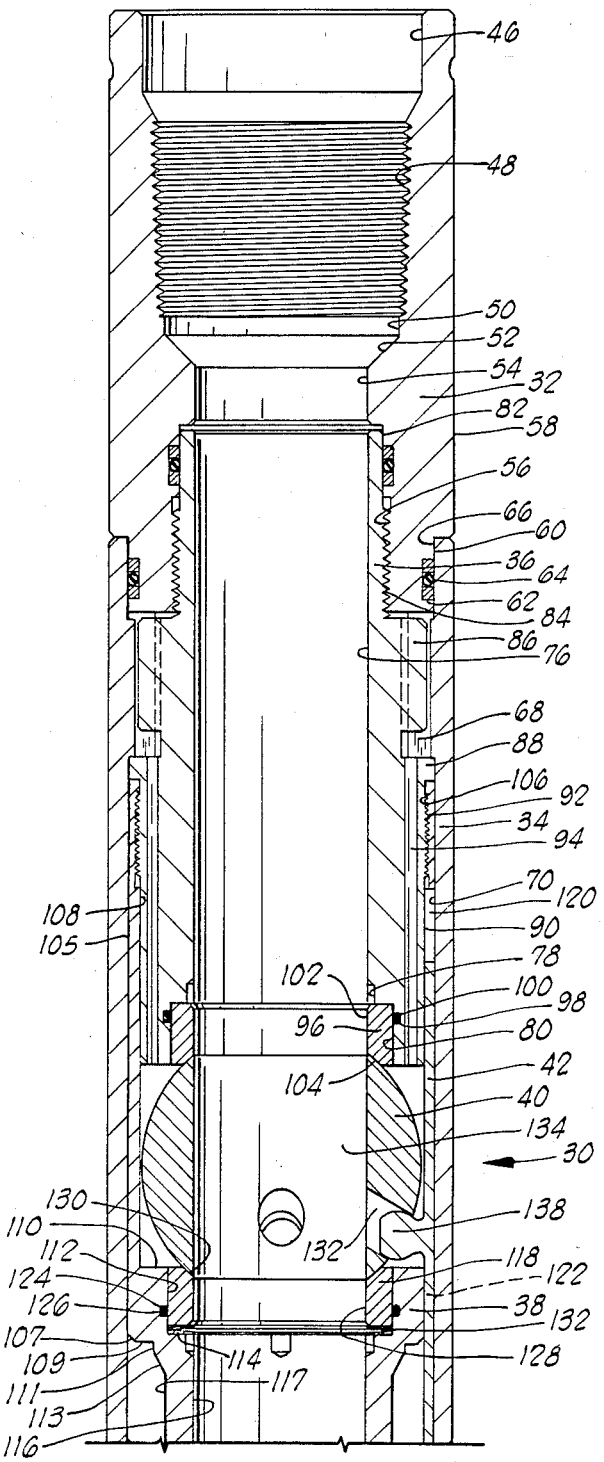
Figure 2B:
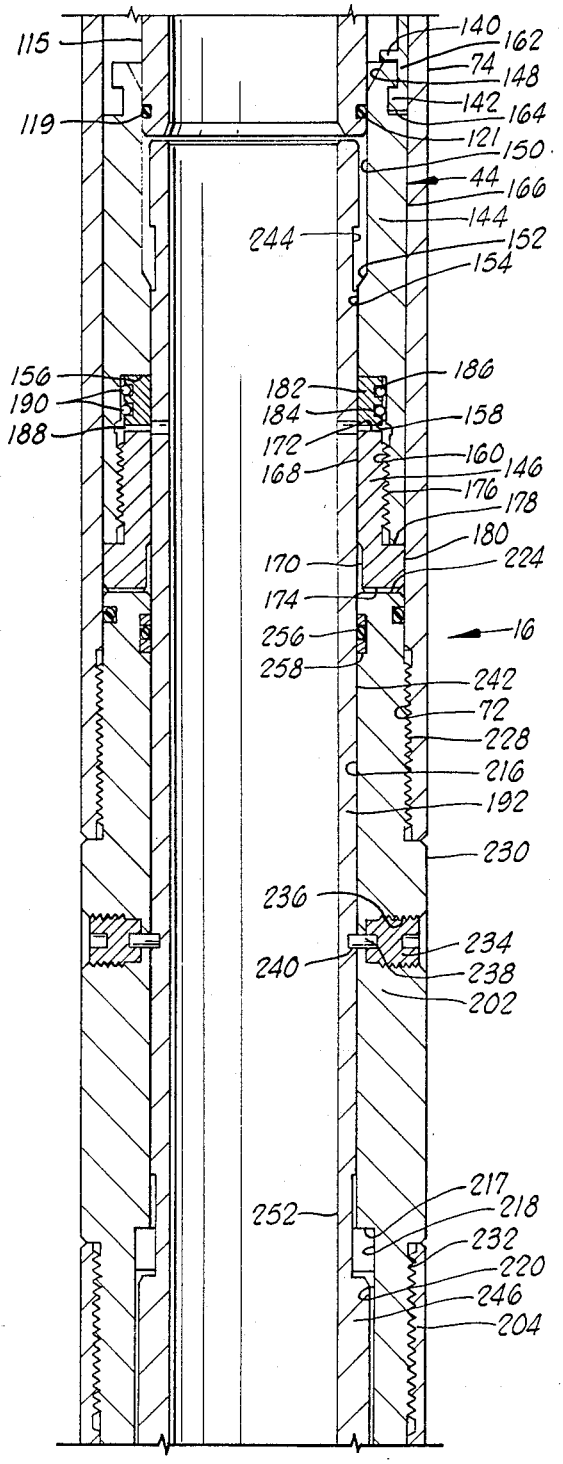
Figure 2C:
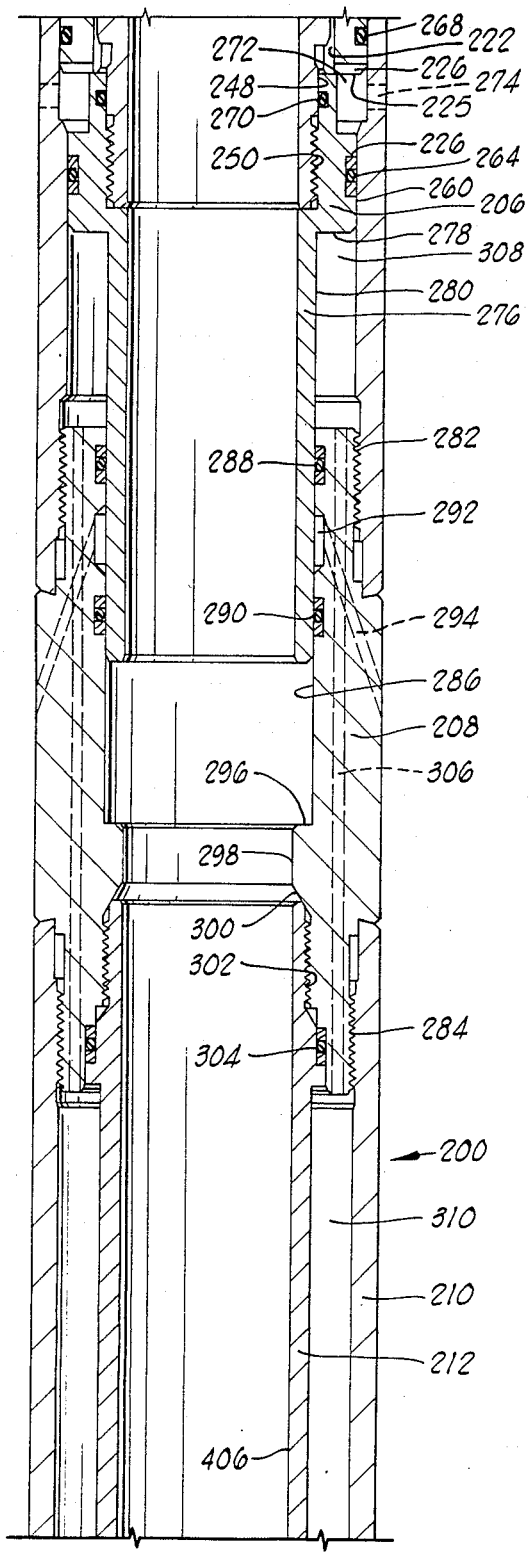
Figure 2D:
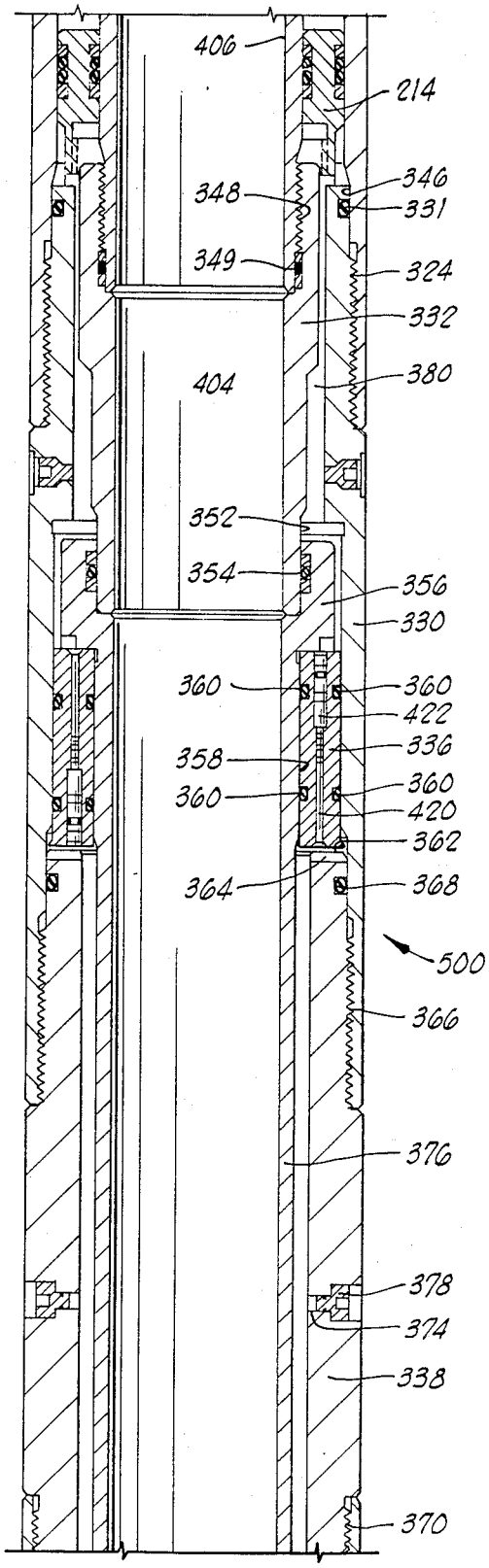
Figure 2E:
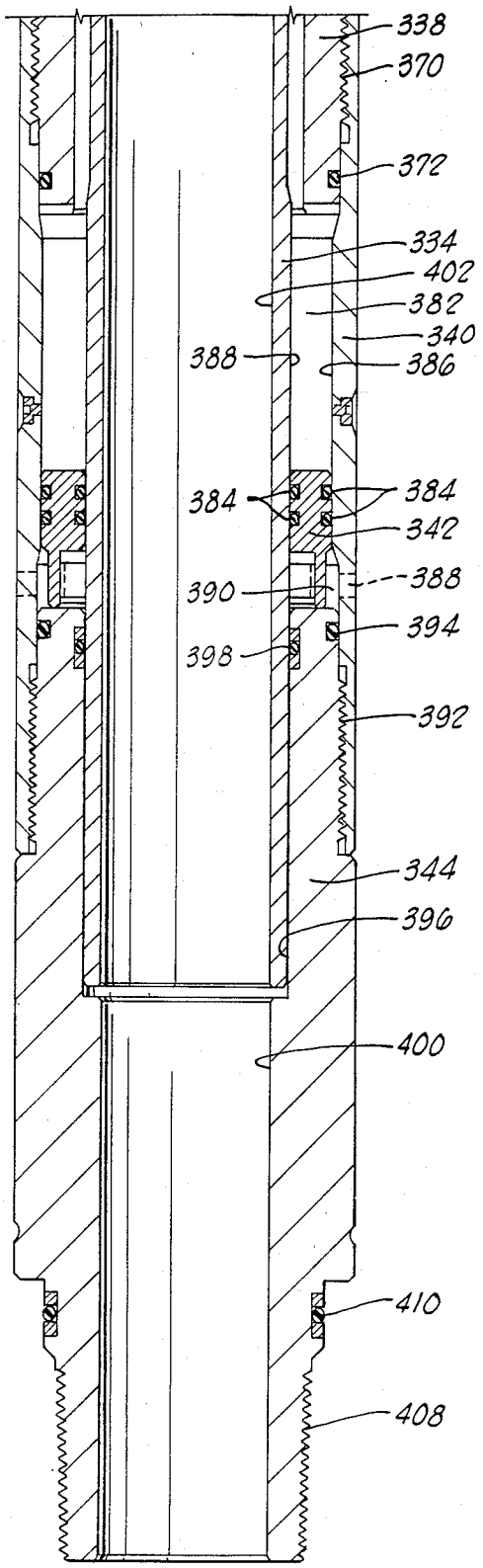

Referring to FIG. 1 of the present invention, a testing string for use in an offshore oil or gas well is schematically illustrated.

In FIG. 1, a floating work station is centered over a submerged oil or gas well located in the sea floor 2 having a wellbore 3 which extends from the sea floor 2 to a submerged formation 5 to be tested. The wellbore 3 is typically lined by a steel liner 4 cemented into place. A subsea conduit 6 extends from the deck 7 of the floating work station 1 into a wellhead installation 10. The floating work station 1 has a derrick 8 and a hoisting apparatus 9 for raising and lowering tools to drill, test, and complete the oil or gas well.

A testing string 14 is being lowered in the wellbore 3 of the oil or gas well. The testing string includes such tools as a pressure balanced slip joint 15 to compensate for the wave action of the floating work station 1 as the testing string is being lowered into place, a tester valve 16 and a circulation valve 17.

The slip joint 15 may be similar to that described in U.S. Pat. No. 3,354,950 to Hyde. The circulation valve 17 is preferably of the annulus pressure responsive type and may be that described in U.S. Pat. No. 3,850,250 to Holden et al, or may be a combination circulation valve and sample entrapment mechanism similar to those disclosed in U.S. Pat. No. 4,063,593 to Jessup or U.S. Pat. No. 4,064,937 to Barrington. The circulation valve 17 may also be the reclosable type as described in U.S. Pat. No. 4,113,012 to Evans et al.

A check valve assembly 20 as described in U.S. Pat. No. 4,328,866 which is annulus pressure responsive may be located in the testing string below the tester valve 16 of the present invention.

The tester valve 16, circulation valve 17 and check valve assembly 20 are operated by fluid annulus pressure exerted by a pump 11 on the deck of the floating work station 1. Pressure changes are transmitted by a pipe 12 to the well annulus 13 between the casing 4 and the testing string 14. Well annulus pressure is isolated from the formation 5 to be tested by a packer 18 set in the well casing 4 just above the formation 5. The packer 18 may be a Baker Oil Tools Model D packer, the Otis type W packer, the Halliburton Services EZ Drill® SV packer, or other packers well known in the well testing art.

The testing string 14 includes a tubing seal assembly 19 at the lower end of the testing string which "stings" into or stabs through a passageway through the production packer 18 for forming a seal isolating the well annulus 13 above the packer 18 from an interior bore portion 1000 of the well immediately adjacent the formation 5 and below the packer 18.

A perforating gun 1005 may be run via wireline to or may be disposed on a tubing string at the lower end of testing string 14 to form perforations 1003 in casing 4, thereby allowing formation fluids to flow from the formation 5 into the flow passage of the testing string 14 via perforations 1003. Alternatively, the casing 4 may have been perforated prior to running testing string 14 into the wellbore 3.

A formation test controlling the flow of fluid from the formation 5 through the flow channel in the testing string 14 by applying and releasing fluid annulus pressure to the well annulus 13 by pump 11 to operate tester valve 16, circulation valve assembly 17 and check valve means 20 and measuring of the pressure buildup curves and fluid temperature curves with appropriate pressure and temperature sensors in the testing string 14 is fully described in the aforementioned patents.

DESCRIPTION OF THE PREFERRED EMBODIMENT OF THE INVENTION

Referring to FIGS. 2*a* through 2*e* tester valve 16 employing a lost-motion valve actuator is shown. The tester valve 16, which may be utilized in the method of the present invention, comprises a valve section 30, power section 200, and metering section 500.

The valve section 30 comprises a top adapter 32, valve case 34, upper valve support 36, lower valve support 38, ball valve 40, ball valve actuation arms 42 and lost-motion actuation sleeve assembly 44.

The adapter 32 comprises a cylindrical elongated annular member having first bore 46, first threaded bore 48 of smaller diameter than bore 46, second bore 50 of smaller diameter than bore 48, annular chamfered surface 52, third bore 54 which is smaller in diameter than bore 50, second threaded bore 56 of larger diameter than bore 54, first cylindrical exterior portion 58 and second cylindrical exterior portion 60 which is of smaller diameter than portion 58 and which contains annular seal cavity 62 having seal means 64 therein.

The valve case 34 comprises a cylindrical elongated annular member having a first bore 66, a plurality of internal lug means 68 circumferentially spaced about the interior of the valve case 34 near one end thereof, second bore 70 which is of substantially the same diameter as that of bore 66, threaded bore 72 and cylindrical exterior surface 74 thereon. The bore 66 sealingly engages second cylindrical exterior portion 60 of the adapter 32 when the case 34 is assembled therewith.

The upper valve seat holder 36 comprises a cylindrical elongated annular member having first bore 76, annular recess 78, second bore 80 of larger diameter than bore 76, annular groove 98 in the wall of second bore 80 holding seal ring 100, first cylindrical exterior portion 82, exterior threaded portion 84, a plurality of lugs 86 circumferentially spaced about the exterior of the upper valve seat holder 36 which lugs 86 are received between the plurality of internal lug means 68 circumferentially spaced about the interior of case 34, annular shoulder 88 on the exterior thereof, second cylindrical exterior portion 90 including threads 92 on the exterior thereof and having longitudinal vent passages therethrough. Received within second bore 80 of the upper valve seat holder 36 is valve seat 96 having bore 102 therethrough and having spherical surface 104 on one end thereof.

The ball valve cage 38 comprises an elongated tubular cylindrical member having first threaded bore 106, second smooth bore 108 of substantially the same diameter as bore 106, radially flat annular wall 110, third bore 112 of smaller diameter than second bore 108, annular shoulder 114 therein and fourth bore 116 of smaller diameter than third bore 112. Longitudinally elongated windows 120 extend through the wall of ball valve cage 38 from the upper end of second smooth bore 108 to wall 110, whereat the windows 120 extend into arcuate longitudinally extending recesses 122. Received within third bore 112 of the ball valve cage 38 is valve seat 118 having bore 128 therethrough and having spherical surface 130 on one end thereof, elastomeric seal 124 residing in annular recess 126 in the wall of third bore 112. Belleville springs 132 bias valve seat 118 against ball valve 40.

The exterior of ball valve cage 38 comprises a first exterior cylindrical portion 105, extending via chamfered surface 107 and radial wall 109 to annular edge 111 and tapered surface 113 to second exterior cylindrical surface 115 having flats 117 thereon and annular recess 119 therein, within which seal means 121 reposes.

The ball valve cage 38 is secured to the upper valve seat holder 36 by means of threaded first bore 106 engaging threads 92, the upper portion of ball valve cage encompassing exterior portion 90 of valve seat holder 36, flats 121 serving as application points for make-up torque.

Contained between upper valve seat support 36 and ball valve cage 38 is ball valve 40 having a central bore 134 therethrough and a plurality of cylindrical recesses 136 extending from bore 134 to the exterior thereof.

To actuate the ball valve 40 a plurality of arms 42 connected to lost-motion actuation sleeve assembly 44 are utilized.

Each arm 42 comprises an arcuate elongated member, which is located in windows 120, having a spherically shaped radially inwardly extending lug 138 thereon which mates in a cylindrical recess 132 of the ball valve 40, having radially inwardly extending lug 140 thereon and having radially inwardly extending lug 142 on one end thereof which mates with actuator sleeve 44.

The lost-motion actuator sleeve assembly 44 includes a first elongated annular operating connector 144 and second elongated connector insert 146 which are secured together. Operating connector 144 is formed having first annular chamfered surface 148, first bore 150, second annular chamfered surface 152, having threaded bore 150, second bore 154, annular radial wall 156, third bore 158 and threaded bore 160. The exterior of operating connector 144 includes first annular surface 162, annular recess 164, and cylindrical exterior surface 166. Connector insert 146 includes a first cylindrical bore 168 and a second, larger bore 170. The leading edge of 146 is radially flat annular wall 172, and the trailing edge comprises radially flat annular wall 174. The exterior of 146 comprises threaded exterior surface 176, radially flat annular wall 178 and smooth cylindrical exterior surface 180.

Lost-motion actuator sleeve assembly 44 further includes a plurality of arcuate locking dogs 182 of rectangular cross-section and having annular recesses 184 and 186 in the exterior thereof. Locking dogs 182 are disposed in annular recess 188 formed between operating connector 144 and differential piston 146. Garter springs 190 are disposed in recesses 184 and 186 in locking dogs 182, garter springs 190 radially inwardly biasing dogs 182 against the exterior of shear mandrel 192, which is included in the lost-motion valve actuator of the present invention.

Operating connector 144 engages arms 42 via the interaction of lugs 140 and 142 with shoulder 162 and recess 164. First bore 150 of operating connector 144 sealingly engages exterior surface 115 on ball valve cage 38.

The power section 200 of the tester valve 16 comprises shear nipple 202, shear mandrel 192, power cylinder 204, compression mandrel 206, filler valve body 208, nitrogen chamber case 210, nitrogen chamber mandrel 212 and floating balancing piston 214.

Shear nipple 202 includes an elongated tubular body having a first bore 216, a radial wall 217, a second bore 218, and a third bore 220 having inwardly radially extending splines 222 thereon. The leading edge of nipple 202 is an annular, radially flat wall 224, while the trailing edge is an annular, radially flat wall 225 including slots 226 therein. The exterior of shear nipple 202 includes leading threaded surface 228, cylindrical surface 230, and trailing threaded surface 232. Shear pin retainer 234 is threaded into aperture 236 to maintain shear pin 238, extending into annular groove 240 in shear mandrel 192, in place.

Shear mandrel 192 comprises an elongated tubular member having a cylindrical exterior surface 242 in which annular dog slot 244, and shear pin groove 240, are cut. Below surface 242, splines 246 extend radially outwardly to mesh with splines 222 of shear nipple 202. Below splines 246 is disposed cylindrical seal surface 248 and threaded surface 250. The interior of shear mandrel 192 comprises smooth bore 252, vent passages 254 extending through the wall of mandrel 192 between the interior and exterior thereof. Seal means 256 carried in recess 258 on the interior of shear nipple 202 slidingly seals against shear mandrel 192.

Below shear nipple 202, the outer annular surface 260 of compression mandrel 206 rides against inner wall 262 of power cylinder 204, seal means 264 in recess 266 slidingly sealing therebetween. Above compression mandrel 206, O-ring 268 seals between shear nipple 202 and power cylinder 204. O-ring 270 seals between compression mandrel 206 and seal surface 248 of shear mandrel 293 above threaded connection 250.

Well fluid power chamber 272, fed by power ports 274 through the wall of power cylinder 204, is defined between shear nipple 202, power cylinder 204, compression mandrel 206 and shear mandrel 192, power chamber 272 varying in length and volume during the stroke of shear mandrel 192 and compression mandrel 206.

The lower portion of compression mandrel 206 compresses tubular segment 276 below radial face 278, the lower end of tubular segment 276 having cylindrical surface 280.

Filler valve body 208 includes a cylindrical medial portion above and below which are extensions of lesser diameter, by which filler valve body 208 is threaded at 282 to power mandrel 204 and at 284 to nitrogen chamber 210. The upper interior of filler valve body 208 includes bore wall 286, in which tubular segment 276 of compression mandrel 206 is received, seal means 288 and 290 carried by filler valve body 208 providing a sliding seal. Annular relief chamber 292, between seal means 288 and 290, communicates with the exterior of the tool via oblique relief passage 294 to prevent pressure locking during the stroke of mandrel 206. Below bore wall 286, radial shoulder 296 necks inwardly to constricted bore wall 298, below which beveled surface 300 extends outwardly to threaded junction 302 between filler valve body 208 and nitrogen chamber mandrel 212, seal means 304 carried on mandrel 212 effecting a seal therebetween.

A plurality of longitudinally extending passages 306 in filler valve body 208 communicate between upper nitrogen chamber 308 and lower nitrogen chamber 310. Filler valve body contains a nitrogen filler valve such as is known in the art, whereby chambers 308 and 310 of the tool are charged at the surface with nitrogen from a pressurized cylinder. Such a valve is disclosed in U.S. Pat. No. RE 29,562 to Wray et al.

Nitrogen chamber case 210 comprises a substantially tubular body having a cylindrical inner wall 312. Nitrogen chamber mandrel 212 is also substantially tubular, and possesses an annular shoulder 314 at the upper end thereof, which carries seal means 304, seal means 304 being contained between flange 316 and filler valve body 208. Annular floating balancing piston 214 rides on exterior surface 318 of mandrel 212, seal means 320 and 322 carried on piston 214 providing a sliding seal between piston 214 and inner wall 312 and exterior surface 318, respectively.

The lower end of nitrogen chamber case 210 is threaded at 324 to metering cartridge housing 330 of metering section 500, which further includes extension mandrel 332, metering mandrel 334, metering cartridge body 336, metering nipple 338, metering case 340, floating oil piston 342, and lower adapter 344.

Metering cartridge housing 330 carries O-ring 331 thereon, which seals against inner seal surface 346 of nitrogen chamber case 210. Nitrogen chamber mandrel 212 is joined to extension mandrel 332 at threaded junction 348, seal means 349 carried in mandrel 332 sealing against seal surface 350 on mandrel 212. The upper end 356 of metering mandrel 334 extends over lower cylindrical surface 352 on extension mandrel 332, seal means 354 effecting a seal therebetween. Metering mandrel 334 necks down below upper end 356 to a smaller exterior diameter comprising metering cartridge body saddle 358, about which annular metering cartridge body 336 is disposed.

Metering cartridge body 336 carries a plurality of O-rings 360, which seal against the interior of metering cartridge housing and saddle 358. Body 336 is maintained in place on saddle 358 between upper end 356 of metering mandrel 334 and upper face 362 having slots 364 therein of metering nipple 338.

Metering nipple 338 is secured at 366 to housing 330, O-ring 368 effecting a seal therebetween, and at 370 to metering case 340, O-ring 372 effecting a seal therebetween. Oil filler port 374 extends from the exterior of tester valve 16 to annular passage 376 defined between nipple 338 and metering mandrel 334, plug 378 closing port 374. Passage 376 communicates with upper oil chamber 380 through metering cartridge body 336, and with lower oil chamber 382, the lower end of which is closed by annular floating oil piston 342. Piston 342 carries O-rings 384 thereon, which maintain a sliding seal between floating piston 342, cylindrical inner surface 386 of metering case 340 and cylindrical exterior surface 388 of metering mandrel 334. Pressure compensation ports 388 extend through the wall of case 340 to pressure compensation chamber 390 below piston 342. Lower adapter 344 is threaded to metering case 340 at 392, O-ring 394 maintaining a seal therebetween, and mandrel bore 396 receives the lower end of metering mandrel 334 therein, seal means 398 effecting a seal therebetween. The exit bore 400 of lower adapter 344, as well as the bores 402 of metering mandrel 334, 404 of extension mandrel 334, and 406 of nitrogen chamber mandrel 212, are of substantially the same diameter. Threads 408 on the exterior of lower adapter 344 connect tester valve 16 to the remainder of the testing string therebelow, seal means 410 maintaining a seal therewith.

Metering cartridge body 336 has a plurality of longitudinally extending passages 420 therethrough, each passage having a fluid resistor 422 disposed therein. Any suitable fluid resistor may be employed, such as those described in U.S. Pat. No. 3,323,550. Alternatively, conventional relief valves may be substituted for, or used in combination with, fluid resistors.

When the tester valve 26 is assembled, chamber 308 and chamber 310, which communicates therewith via passages 306, are filled with inert gas, usually nitrogen, through a filler valve (not shown) in the filler valve body 208 of the tester valve 16, the amount and pressure of the inert gas being determined by the approximate hydrostatic pressure and temperature of the formation at which the tester valve is to be utilized in a wellbore 3. At the same time chambers 380 and 382 are filled with suitable oil via port 374 in metering nipple 338.

When the testing string 14 is inserted and lowered into the wellbore 3, the ball valve 40 is in its open position shown in FIG. 2, which allows fluid to pass into testing string 14 during the descent of the testing string 14 into wellbore 3. Additionally, a water or diesel cushion or formation treating fluids may be spotted into testing string 14 from the top of the string, displacing wellbore fluids in testing string 14 from the bottom thereof.

During the lowering process, the hydrostatic pressure of the fluid in the annulus 13 and the interior bore of the tester valve 16 will increase. At some point, the annulus pressure of the fluid will exceed the pressure of the inert gas in chambers 308 and 310, and the oil piston 342 will begin to move upward due to the pressure differential thereacross from annulus fluid flowing through ports 388 in metering case 340 into chamber 390. When the oil piston 342 moves upwardly in oil filled chamber 382, the oil flows through the metering cartridge body 336 having fluid resistors 422 therein, through chamber 380 and acts on floating balancing piston 214 causing the piston 214 to compress the inert gas in chambers 310 and 308 until the inert gas is at the same pressure as the fluid in the annulus surrounding the tester valve 16. In this manner, the initial pressure given to the inert gas in chambers 308 and 310 will be supplemented to automatically adjust for the increasing hydrostatic fluid pressure in the annulus, and other changes in the environment due to increased temperature.

When the packer 18 is set to seal off the formation 5 to be tested and the tubing seal assembly 19 sealingly engages the packer 18, the pressure of the fluid in the interior bore of the tester valve 16 is then independent of annulus fluid pressure since there is no further communication between them. It should be noted that the open tester valve 16 prevents a pressure buildup in testing string 14 when tubing seal assembly 19 stings into packer 18. The packer may then be pressure tested by increasing the annulus pressure above packer 18 and ascertaining if this increase is transmitted below packer 18. As pressure in annulus 13 is increased, annulus fluid pressure is transmitted through ports 274 to act on compression mandrel 206 and through ports 388 to act on floating oil piston 342. Since a pressure differential exists across compression mandrel 206 with the application of the annulus fluid pressure through ports 274 due to the initial lag in the annulus pressure increase transfer to the inert gas in chambers 308 and 310 before oil can flow through fluid resistors 422 to chamber 380 and act on balancing piston 214, compression mandrel 206 is subjected to a force tending to cause the compression mandrel 206 to move downwardly within the power cylinder 204. When the force from the fluid pressure in the annulus 13 surrounding the tester valve 16 reaches a predetermined level, the force acting on compression mandrel 206 is sufficient to cause shear pins 238, which are retaining shear mandrel 192 in its initial position, to be sheared thereby allowing the shear mandrel 192 and compression mandrel 206 to move downwardly.

Concurrently with the movement of the compression mandrel 206, the increased fluid pressure in the annulus 13 of the wellbore causes floating oil piston 342 to move upwardly within chamber 390 thereby causing oil to gradually flow through metering cartridge body 330 into chamber 380 causing, in turn, the balancing piston 214 to move upwardly in chamber 310 thereby compressing the inert gas therein and in chamber 308 to an increased pressure level to provide a return force in the power section to act on the compression mandrel 206 when annulus pressure is released.

When the shear mandrel 192 moves downwardly with compression mandrel 206, annular dog slot 244 in cylindrical exterior surface 242 slides under locking dogs 182 in recess 188. Garter springs 190 pull dogs 182 into dog slot 244, thus securing shear mandrel 192 to operating connector 144 and connector insert 146. However, ball valve 40 does not rotate during this initial downward travel of shear mandrel 192, as operating connector 144 is unsecured to shear mandrel 192 during the latter's downward travel. Therefore, tester valve 16 does not cycle during the initial annulus pressure increase, ball valve 40 remaining open.

To initially close the ball valve 40, fluid pressure in the annulus 13 of the wellbore 3 surrounding the tester valve 16 is reduced to its hydrostatic fluid pressure level thereby allowing the higher pressure compressed inert gas in chambers 308 and 310 to act as a piston return force. The inert gas expands, moving balancing piston 214 and oil piston 342 gradually downwardly in the tester valve 16 due to the flow restriction effected by fluid resistors 422 while moving the compression mandrel 206 and shear mandrel 192 rapidly upwardly in the tester valve 16, closing the ball valve 40 through the connection of shear mandrel 192 via locking dogs 182 to operating connector 144 and connector insert 146, operating connector 144 causing arms 42 of lost-motion actuation sleeve assembly 44 to move upwardly in ball valve case 38, lugs 138 rotating ball valve 40 to a closed position. To reopen ball valve 40, pressure in annulus 13 is again increased, moving compression mandrel 206 and shear mandrel 192 downwardly, thereby rotating ball valve 40 via lugs 138 on actuating arms 42 due to the connection of shear mandrel 192 to operating connector 144 via locking dogs 182 and dog slot 244. The downward movement of the compression mandrel 206 ceases when the radial face 174 abuts the upper end of shear nipple 202. After the initial pressure increase/decrease cycle, the tester valve 16 opens upon each annulus pressure increase and closes upon a reduction of annulus pressure.

It will be recognized that in the method of the present invention the initial closing of the tester valve 16 employing a lost-motion valve actuator may be preceded by filling of testing string 14 with wellbore fluid as it is run into the wellbore, thus saving rig time. Moreover, in the method of the present invention spotting of a water or diesel cushion or treating fluids into testing string 14 by displacing wellbore fluid out of the bottom of the open string saves additional time and eliminates the possibility of driving large volumes of wellbore fluid into the formation ahead of the treating fluids. After the testing string 14 is stung into packer 18, annulus pressure may be increased to pressure test the packer 18 without cycling the tester valve 16. Moreover, since testing string 14 is open when it stings into packer 18, the formation pressure does not build up below a closed tool bore closure valve as is the case with prior art methods. If a packer is employed as an integral part of testing string 14 rather than utilizing a previously set production packer, the same advantage of pressure-testing the packer obtains. Finally, when annulus pressure is released to hydrostatic after the first annulus pressure increase, ball valve 40 in tester valve 16 is closed by lost-motion actuator sleeve assembly 44, which has locked the operating connector 144 into positive control by shear mandrel 192 and compression mandrel 206.

It is thus apparent that a novel and unobvious method of flow testing a wellbore formation has been invented, providing numerous advantages over the prior art. While disclosed in the context of a tester valve, the present invention is equally applicable to safety valves, sampler valves or circulating valves. Furthermore, the nitrogen/oil power mechanism as disclosed in tester valve 16 is not required, as any annulus pressure responsive valve actuating mechanism may be employed with the present invention. Moreover, many additions, deletions and other modifications may be made to the preferred embodiment without departing from the spirit and scope of the claimed invention.

We claim:

1. A method of flow testing a formation in a wellbore, comprising:

providing a testing string including at least one annulus pressure responsive tool bore closure valve;

providing a packer and setting said packer in said wellbore to seal thereacross;

running said testing string into said wellbore with said tool bore closure valve in an open position;

stinging into said set packer with the bottom of said testing string;

increasing pressure a first time in the wellbore annulus around the testing string and above said set packer without cycling said tool bore closure valve;

reducing pressure in said wellbore annulus;

closing said tool bore closure valve responsive to said pressure reduction;

increasing pressure a second time in said wellbore annulus;

reopening said tool bore closure valve responsive to said second pressure increase; and flowing fluids from said formation through said reopened tool bore closure valve.

2. The method of claim 1, further including the step of pressure testing the set packer during said first annulus pressure increase, by ascertaining if said annulus pressure increase is transmitted to the wellbore below said set packer.

3. The method of claim 1, further including the step of spotting a fluid into said testing string from the top thereof by displacing wellbore fluid through said open valve from the bottom of said testing string prior to stinging into said set packer.

4. The method of claim 3, wherein said spotted fluid comprises water.

5. The method of claim 3, wherein said spotted fluid comprises an oil-based fluid of lesser density than said wellbore fluid.

6. The method of claim 3, wherein said spotted fluid comprises a formation treating fluid.

7. A method of flow testing a formation in a wellbore, comprising:

providing a testing string including a packer and at least one annulus pressure responsive tool bore closure valve;

running said testing string into said wellbore with said tool bore closure valve in an open position;

setting said packer in said wellbore to seal thereacross;

increasing pressure a first time in the wellbore annulus surrounding said testing string above said set packer without cycling said tool bore closure valve;

reducing pressure in said wellbore annulus;

closing said tool bore closure valve responsive to said pressure reduction;

increasing pressure a second time in said wellbore annulus;

reopening said tool bore closure valve responsive to said second pressure increase; and flowing fluids from said formation through said reopened tool bore closure valve.

8. The method of claim 7, further including the step of pressure testing the set packer during said first annulus pressure increase, by ascertaining if said annulus pressure increase is transmitted to the wellbore below said set packer.

9. The method of claim 7, further including the step of spotting a fluid into said testing string from the top thereof by displacing wellbore fluid through said open valve from the bottom of said testing string prior to setting said packer.

10. The method of claim 7, wherein said spotted fluid comprises water.

11. The method of claim 7, wherein said spotted fluid comprises oil-based fluid of lesser density than said wellbore fluid.

12. The method of claim 7, wherein said spotted fluid comprises a formation treating fluid.

13. The method of claim 1, further including:

filling said testing string from the bottom thereof through said open tool bore closure valve with wellbore fluid as said testing string is run into said wellbore before stinging into said set packer.

14. The method of claim 7, further including:

filling said testing string from the bottom thereof through said open tool bore closure valve with wellbore fluid as said testing string is run into said wellbore before setting said packer.

* * * * *